US005970632A

United States Patent [19]

Watson

[11] Patent Number: 5,970,632

[45] Date of Patent: Oct. 26, 1999

[54] SNOWSHOE WITH ADJUSTABLE BINDINGS

[75] Inventor: Jim Watson, Grand Junction, Colo.

[73] Assignee: Spring Brook Manufacturing, Inc,, Grand Junction, Colo.

[21] Appl. No.: 09/241,047

[22] Filed: Feb. 1, 1999

Related U.S. Application Data

[63] Continuation-in-part of application No. 08/840,513, Apr. 21, 1997, Pat. No. 5,881,477, which is a continuation-in-part of application No. 08/506,784, Jul. 25, 1995, abandoned.

[51] Int. Cl.[6] ..... A43B 5/04; A43B 3/26

[52] U.S. Cl. ..... 36/122; 36/97

[58] Field of Search ..... 36/122, 123, 124, 36/125, 97

[56] References Cited

U.S. PATENT DOCUMENTS

| | | | |
|---|---|---|---|
| D. 94,639 | 2/1935 | Stritter . | |
| 536,812 | 4/1895 | Mabee . | |
| 1,155,982 | 10/1915 | Withycombe . | |
| 1,523,222 | 1/1925 | Leet . | |
| 2,097,249 | 10/1937 | Keene | 36/4.5 |
| 2,615,260 | 10/1952 | Paden | 36/122 |
| 3,299,541 | 1/1967 | Snyder | 36/4.5 |
| 3,464,127 | 9/1969 | Muncie | 36/7.6 |
| 3,638,333 | 2/1972 | Sprandel | 36/4.5 |
| 3,673,713 | 7/1972 | Fedewitz | 36/2.5 |
| 3,755,926 | 9/1973 | Schonbrun | 36/2.5 |
| 4,004,355 | 1/1977 | Koblick | 36/122 |
| 4,213,256 | 7/1980 | Mas et al. | 36/124 |
| 4,228,601 | 10/1980 | Lawton et al. | 36/124 |
| 4,344,238 | 8/1982 | Peyser | 36/62 X |
| 4,525,939 | 7/1985 | McNeil et al. | 36/62 X |
| 4,604,817 | 8/1986 | Ramboz | 36/125 |
| 5,014,450 | 5/1991 | McGrath | 36/124 |
| 5,228,216 | 7/1993 | Sargeant | 36/11.5 |
| 5,339,542 | 8/1994 | Kim | 36/132 X |
| 5,341,582 | 8/1994 | Liautaud | 36/124 X |
| 5,459,950 | 10/1995 | Damm et al. | 36/122 |
| 5,493,794 | 2/1996 | McKenzie et al. | 36/124 X |
| 5,881,477 | 3/1999 | Watson | 36/122 |

FOREIGN PATENT DOCUMENTS

| | | | |
|---|---|---|---|
| 634114 | 1/1962 | Canada | 36/122 |
| 2409066 | 7/1979 | France | 36/124 |

*Primary Examiner*—B. Dayoan
*Attorney, Agent, or Firm*—Fields and Johnson, P.C.

[57] ABSTRACT

An improved snowshoe is provided which includes a unitary molded planar platform and a peripheral curved lip extending away from the platform. Integral with the underside of the platform is a plurality of stiffening ribs to provide support to the platform. Retaining straps are provided for securing a wearer's foot to the snowshoe platform. A plurality of slots are formed through the platform which enables snow trapped on the surface of the platform to fall therethrough. In a first embodiment, the slots also serve as anchor points for selective placement of the retaining straps and selective positioning of the foot on the platform. Based upon the wearer's desire, the straps may be arranged in a number of different combinations and selectively adjusted to accommodate the particular type of foot gear worn. A second embodiment enables the platform to receive either a cross-country ski binding or a snowboard binding. A third embodiment discloses a snowshoe having a binding especially adapted for use by children. A fourth embodiment discloses the snowshoe platform being usable as a shovel by attaching a handle thereto. A fifth embodiment incorporates the use of a binding having a rotatable metatarsal strap which can also be selectively removed or adjusted.

3 Claims, 14 Drawing Sheets

10
A
26
70
18c
18a
18d
28
28
18b
14
28
28
4
4
18h
18f
18g
18e
12
18j
17
5
5
40
56
18i
18
20
20
16
A

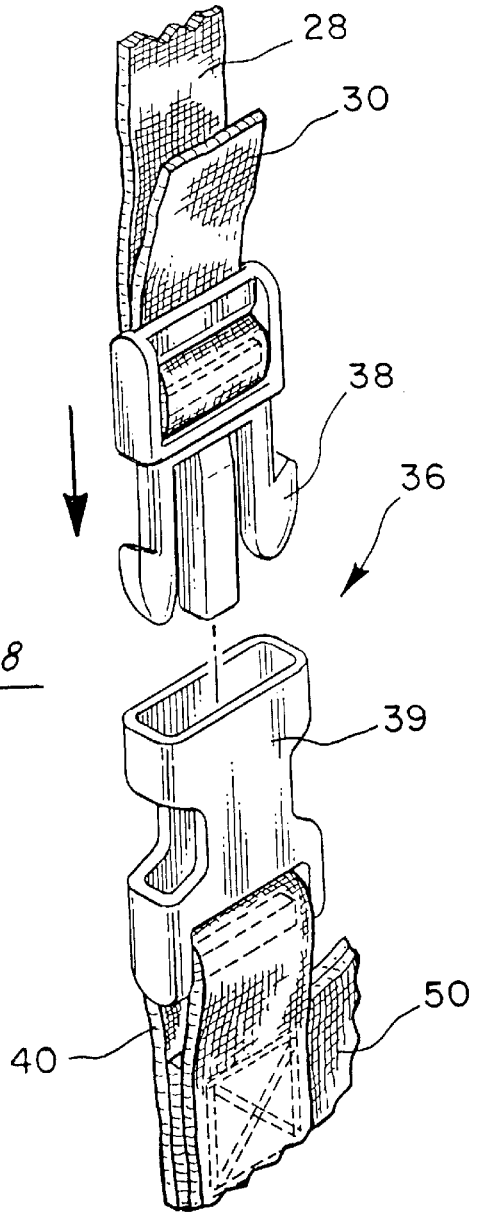
Fig. 8
Fig. 9
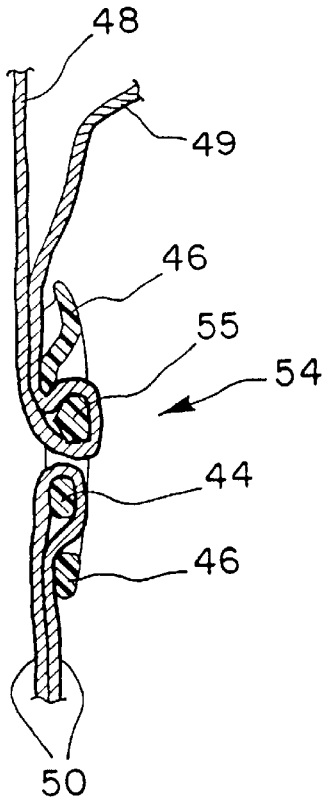
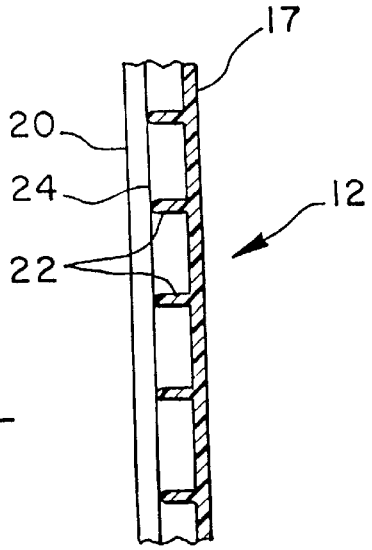
Fig. 10

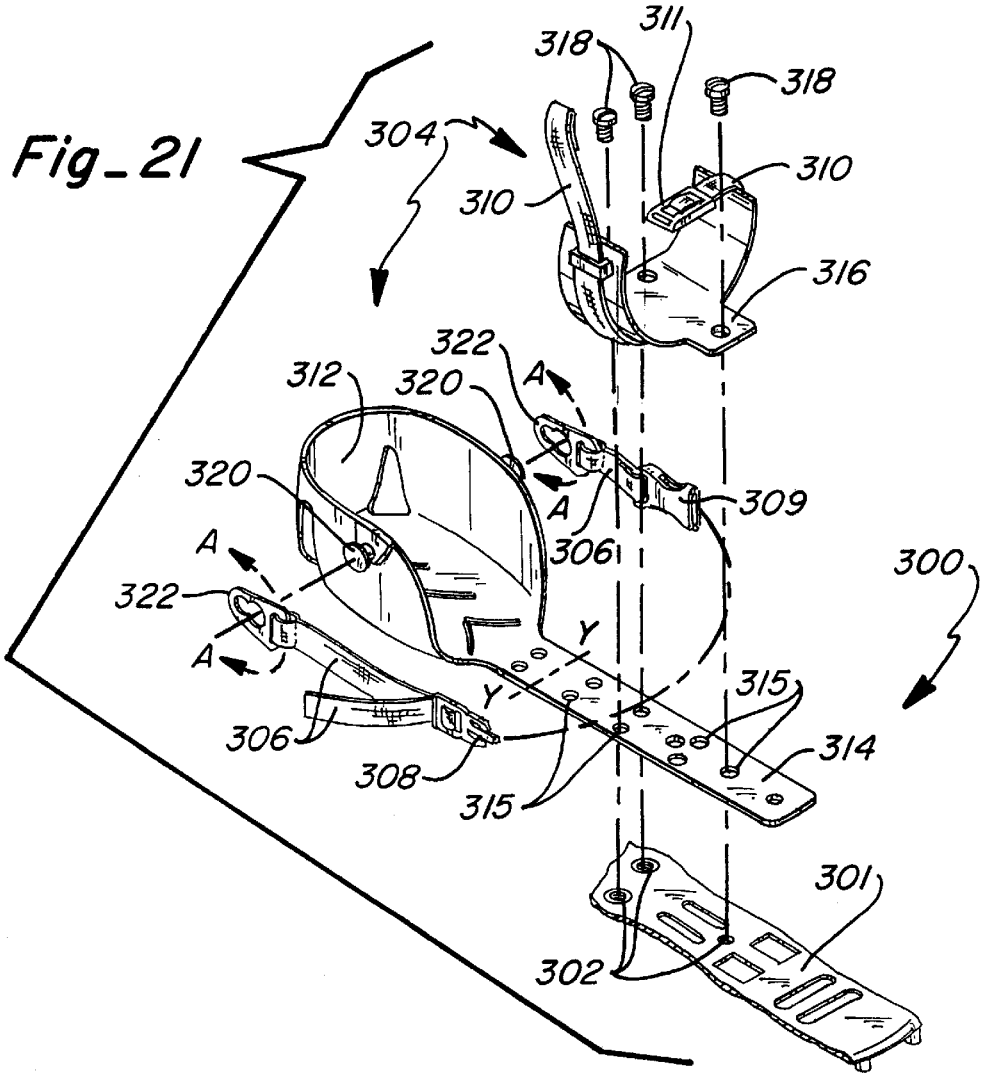
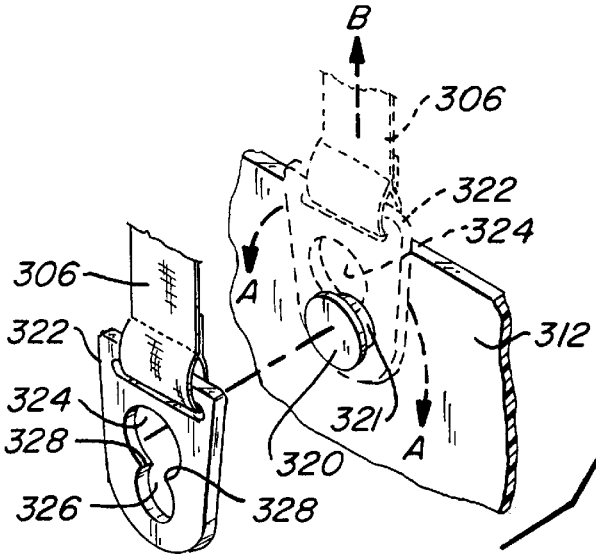
Fig_22

SNOWSHOE WITH ADJUSTABLE BINDINGS

This application is a continuation-in-part application of U.S. Ser. No. 08/840,513 filed Apr. 21, 1997, and entitled "Snowshoe With Adjustable Bindings", now U.S. Pat. No. 5,881,477, which is a continuation-in-part of U.S. Ser. No. 08/506,784, filed Jul. 25, 1995, now abandoned.

TECHNICAL FIELD

This invention relates to a snowshoe with adjustable bindings and, more particularly, to an improved snowshoe adapted for use with a multitude of different types of foot gear including foot gear used in winter recreational activities.

BACKGROUND ART

Many types of designs exist for snowshoes. Each of these designs usually incorporates one or more features which are intended to achieve a specific advantage relating to use of the snowshoe for a specified purpose.

One example of a prior art snowshoe designed to achieve a specific advantage is U.S. Pat. No. 3,673,713 to Fedewitz. This invention teaches a snowshoe made of injection molded polypropylene wherein the tread of the snowshoe has a plurality of resiliently hinged flaps angled downwardly as measured from a horizontal. The flaps are intended to help the snowshoe wearer remain on top of snow when worn, but also to help remove snow collected on the upper surface of the snowshoe when the snowshoe is lifted above the snow. The foot of the snowshoe wearer rotates about a hinge point on the snowshoe located near the ball of the foot.

U.S. Pat. No. 3,299,541 to Snyder teaches a snowshoe including tread formed of plastic material, and further having harness engaging means formed upon an integrally connected hinge portion. A toe aperture portion formed in the forward portion of the snowshoe tread enables a wearer's foot to rotate about a hinge point located near the ball of the foot. In use, the foot rotates about the hinge point such that the entire foot, except for the toe portion, rises above the snowshoe platform.

U.S. Pat. No. 3,638,333 to Sprandel discloses a molded plastic snowshoe including a frame with webbing therebetween, and a transversely extending pivot with a horizontal opening defined in the snowshoe immediately in front of the pivot. A one-piece molded plastic harness includes two straps which encircle the pivot and extend around the rear of a boot, and a third strap that forms a loop to receive and hold the toe of the boot. Thus, the harness pivotally engages the boot on the snowshoe and the opening in the snowshoe allows the toe of the boot to pass therethrough during perambulation.

U.S. Pat. No. 4,213,256 to Mas, et al. discloses a snowshoe comprising a flat member which is bisymmetric in that its upper and lower sides are mirror images of each other. A portion of the snowshoe supporting the foot is displaced toward the inner side of the snowshoe, and the laterally outer portion comprises an open gridwork supported by a frame, the whole snowshoe being of a molded plastic construction. The portion of the snowshoe supporting the foot is provided with holes adjacent the margins of the foot or shoe of the user; and a single lace can be inserted through these holes to provide front and rear bindings for the foot or shoe.

While each of these prior art inventions may be adequate for their intended purposes, none of the prior art devices include advantages of the present invention which will become apparent through the disclosure provided herein. One advantage of the present invention over the prior art is that means are provided to enable a user of the snowshoe to wear a number of differing types of foot gear. That is, a user of the present invention is not restricted to use of a particular size or style of footwear. Another advantage over the prior art is that during perambulation, the rotation of the wearer's foot occurs at the very front edge of the snowshoe which enables the wearer to obtain better gripping action on frozen snow or ice. This positioning of the point of rotation at the front edge of the snowshoe also enables a wearer to achieve a more natural walking motion as opposed to traditional snowshoes which require a wearer to lift the snowshoe after the foot has pivoted. Another advantage over the prior art is that the foot may be selectively positioned on the snowshoe depending upon the wearer's choice and the environmental conditions in which the snowshoe is used.

The improved snowshoe of this invention also provides a means by which the snowshoe can receive either a cross-country-type ski binding or a snowboard-type binding. Often times, snowboarders and cross-country skiers desire to conduct their sporting activities in remote locations which are only accessible by hiking into such locations. Accordingly, the improved snowshoe of this invention enables a cross-country ski boot and/or snowboard boot to be directly attached to the snowshoe in a secure manner which does not degrade the ability to effectively snowshoe in such locations. Cross-country ski boots and snowboard boots typically have portions which extend from the toe and/or heel of the boot. Also the construction of these boots is designed for use with a specific type of binding which provides the wearer a particular type of locomotive capability with respect to cross-country skiing/snowboarding. If these type of boots are used in snowshoes such as disclosed in Sprandel, the toe portions of these boots can become clogged with snow and can significantly degrade the use of the snowshoe since the toe portion may extend too far into the snow. Even if the cross-country ski boot and/or snowboard boot are used in conjunction with snowshoes of the type disclosed in Snyder, effective snowshoeing is degraded since the boot cannot be adequately locked/secured to the snowshoe. Because of these shortcomings with respect to prior art snowshoes which are not well adapted to receive a cross-country ski boot or snowboard boot, the skier or snowboarder may be forced to carry additional foot gear solely for the snowshoeing activity.

Because of the compact size of the snowshoe of this invention, it can be easily carried within a backpack worn by the skier or snowboarder. Even when the cross-country skier or snowboarder is not faced with hiking into a remote region, the ability to attach the boot directly to the improved snowshoe of this invention is advantageous. Deep snow and difficult terrain can be found in many areas which may require the cross-country skier or snowboarder to employ snowshoes.

DISCLOSURE OF THE INVENTION

In accordance with the present invention, an improved snowshoe is provided. In the first preferred embodiment of this invention, a snowshoe platform is provided for distributing the weight of a wearer when traversing snow or ice-covered terrain. The snowshoe platform includes a plurality of slots through which a binding in the form of securing straps is laced. The slots enable snow which may accumulate on the top surface of the platform to fall therebetween, thus acting as the webbing of a traditional snowshoe. The slots, however, also serve a special purpose in that they are arranged in a manner such that the securing straps can be relocated on the snowshoe platform to accommodate differing sizes and shapes of foot gear. Furthermore, the slots enable the wearer to choose differing strap arrangements in order to optimize the attachment of differing styles of foot gear to the platform. For example, in conditions of ice and frozen snow, it may be advantageous to place the toe of the foot at the front edge of the platform while it may be more advantageous to place the foot more rearward on the platform in conditions of light and powdery snow. The securing straps are selectively routed through the slots and securing means are provided to adjustably and releasably attach the desired foot gear to the platform. Based upon the wearer's choice, the straps are selectively routed through the slots in a predetermined pattern that best secures the particular foot gear worn to the snowshoe platform. In the first preferred embodiment, a metatarsal securing strap is provided near the toe and forefoot or metatarsal portion of the foot to secure the corresponding portion of the foot gear to the platform. Also, a heel retaining strap is provided to secure the heel portion of the foot gear to the snowshoe platform.

In a second preferred embodiment of the improved snowshoe of the present invention, a snowshoe platform is provided which includes a plurality of openings spaced in a desired manner which are adapted to receive a snowboard binding or a cross-country ski binding. As discussed above, this embodiment is advantageous for use by those cross-country skiers and/or snowboarders who may wish to utilize a snowshoe without having to change foot gear or face degraded snowshoe capability by using snowshoes which are not designed to adequately secure the cross-country type ski boot or snowboard type boot. As discussed above, one particular disadvantage of using a cross-country ski boot in a prior art snowshoe, which allows the elongated toe portion of the boot to pass through the plane of the decking during movement, is that the elongated toe portion becomes clogged with snow and can get caught up with the ground in shallow snow areas. By rotating the elongated toe portion at the plane of the deckplate with a locked connection between the toe portion and deckplate, clogging and catching can be avoided without degradation of snowshoeing capability. In this second embodiment, the structure of the deckplate is similar to the first embodiment with the exception of the added openings which are adapted to receive the cross-country ski or snowboard bindings.

In a third embodiment of the present invention, a child's snowshoe is provided which is smaller in size than the first and second embodiments, but retains most of the characteristics of the first and second embodiments in terms of the deckplate configuration. This embodiment includes an arrangement of openings which is adapted to receive a binding for use with standard snow boots or any other type of foot gear which may be worn by a child.

In a fourth embodiment of the present invention, the openings formed in the second embodiment for receiving a binding can also be used to receive a modified handle portion of a hand implement or tool such as a shovel or the like.

In a fifth embodiment of the present invention, another child's snowshoe is provided which is similar to the third embodiment, but further includes a rotatable and selectively "snap" removable metatarsal strap.

The exterior periphery of the snowshoe platform in each of the embodiments includes a peripheral curved lip which provides the necessary edge control for traversing sloped terrain. A plurality of stiffening ribs formed integrally with the platform provide the desired support for the platform, and both the ribs and peripheral curved lip serve as a means for gripping the snow or ice-covered terrain.

The snowshoe platform in each of the embodiments is of a unitary molded construction. An appropriate plastic such as polypropylene may be used to provide the desired resiliency wherein the platform supports the foot of the wearer yet provides some flexibility corresponding to the force applied by the foot of the wearer.

BRIEF DESCRIPTION OF THE DRAWINGS

FIG. 8 is an enlarged exploded perspective view of the adjustable coupler element of the present invention;

FIG. 9 is a cross sectional view taken along line 9—9 of FIG. 1 illustrating some of the detail of the adjuster element of the present invention;

FIG. 10 is a longitudinal vertical sectional view taken along line 10—10 of FIG. 3;

FIG. 21 is a fragmentary exploded perspective view of a fifth embodiment of this invention similar to the third embodiment but adding additional features to the binding; and FIG. 22 is an enlarged fragmentary perspective view of the fifth embodiment illustrating the rotatable and "snap" removable metatarsal strap.

BEST MODE FOR CARRYING OUT THE INVENTION

Figure 1:
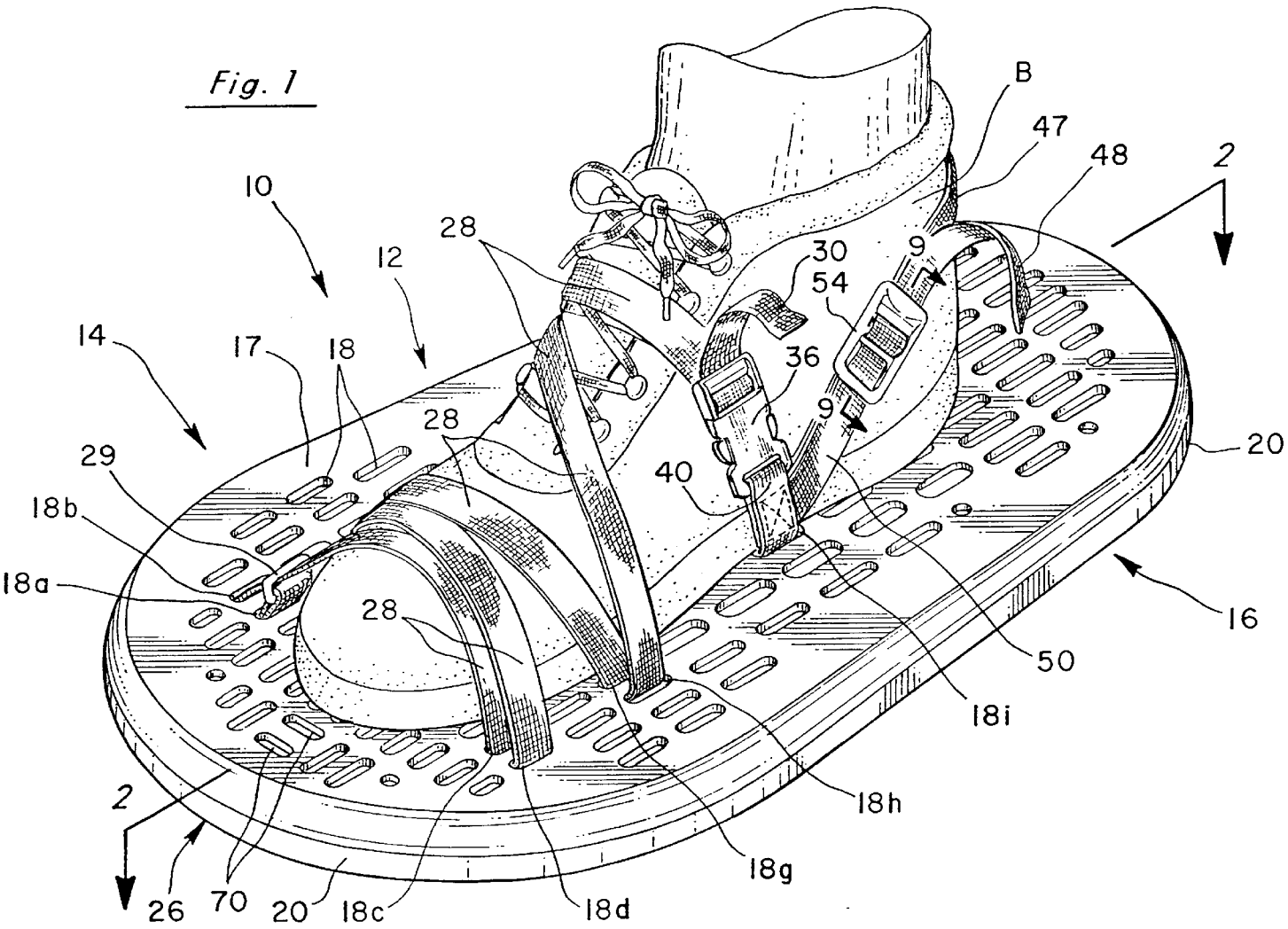
FIG. 1 is a perspective view of a first embodiment of the improved snowshoe of the present invention.
Figure 2:
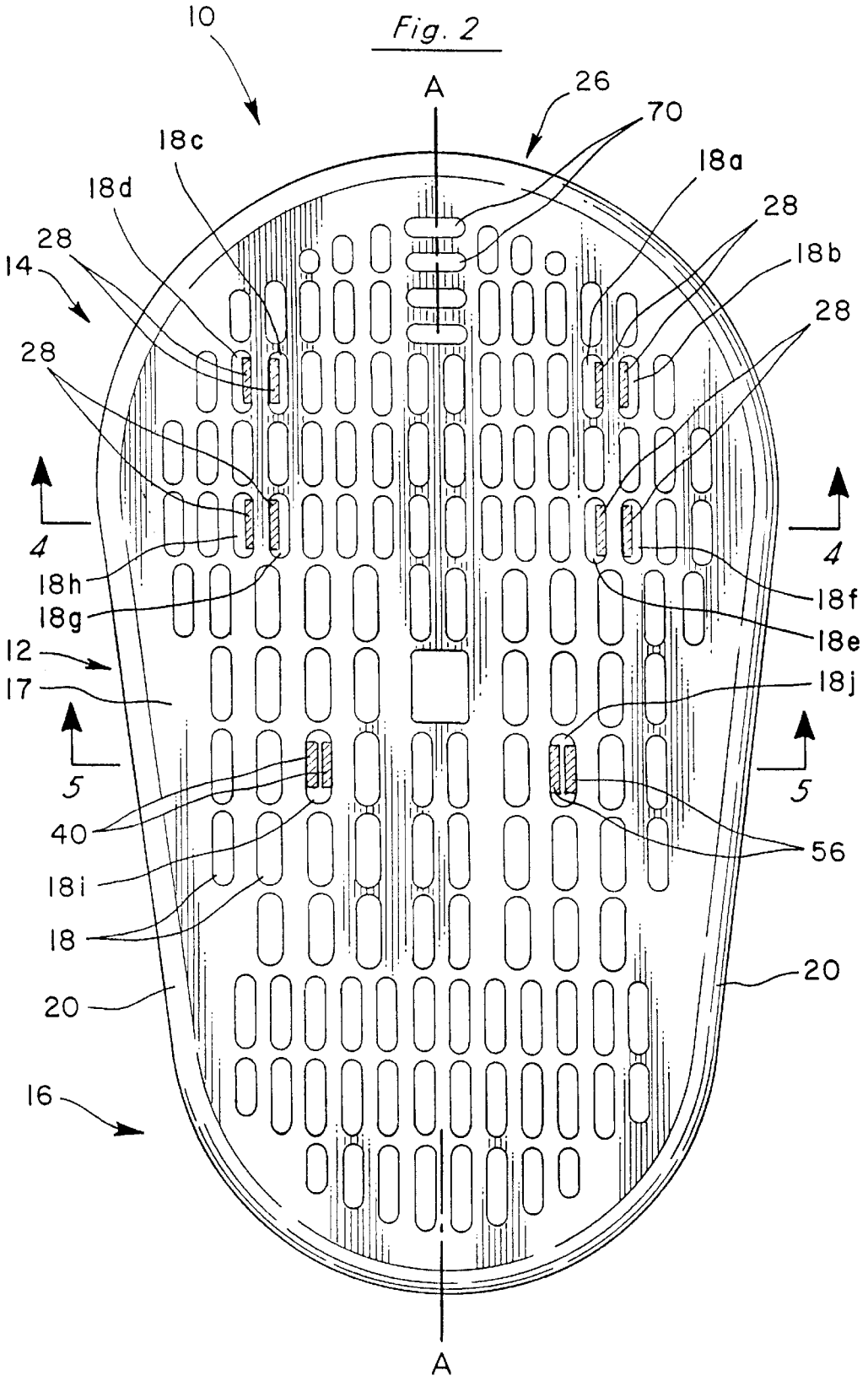
FIG. 2 is a top view of the first embodiment taken along line 2—2 of FIG. 1.

As best seen in FIG. 1 and 2, the first embodiment of the improved snowshoe of this invention 10 comprises a planer platform 12 having a generally oblong shape with a slightly larger frontal area 14 and a smaller rear area 16. Since the center of gravity of a wearer of the present invention is towards the front of the platform, the platform is wider at the frontal area 14 to provide more surface area for Rotational support on the snow or ice. The platform is symmetrical about the axis A—A.

Platform 12 includes decking 17 which has a plurality of longitudinal slots 18. As illustrated, the longitudinal slots may be provided in a plurality of transversely extending rows which are arranged substantially perpendicular to axis A—A. Each of the longitudinal slots are spaced laterally from one another a predetermined distance. As will be explained below, the longitudinal slots serve a dual purpose, one being to allow snow trapped on decking 17 to pass through the snowshoe, and the other purpose being to serve as points of adjustment when using the improved snowshoe with a desired foot gear, such as hiking boot B. The exterior edge of platform 12 forms a peripheral curved lip 20 which extends substantially perpendicular to the plane of the platform 12.

Figure 3:
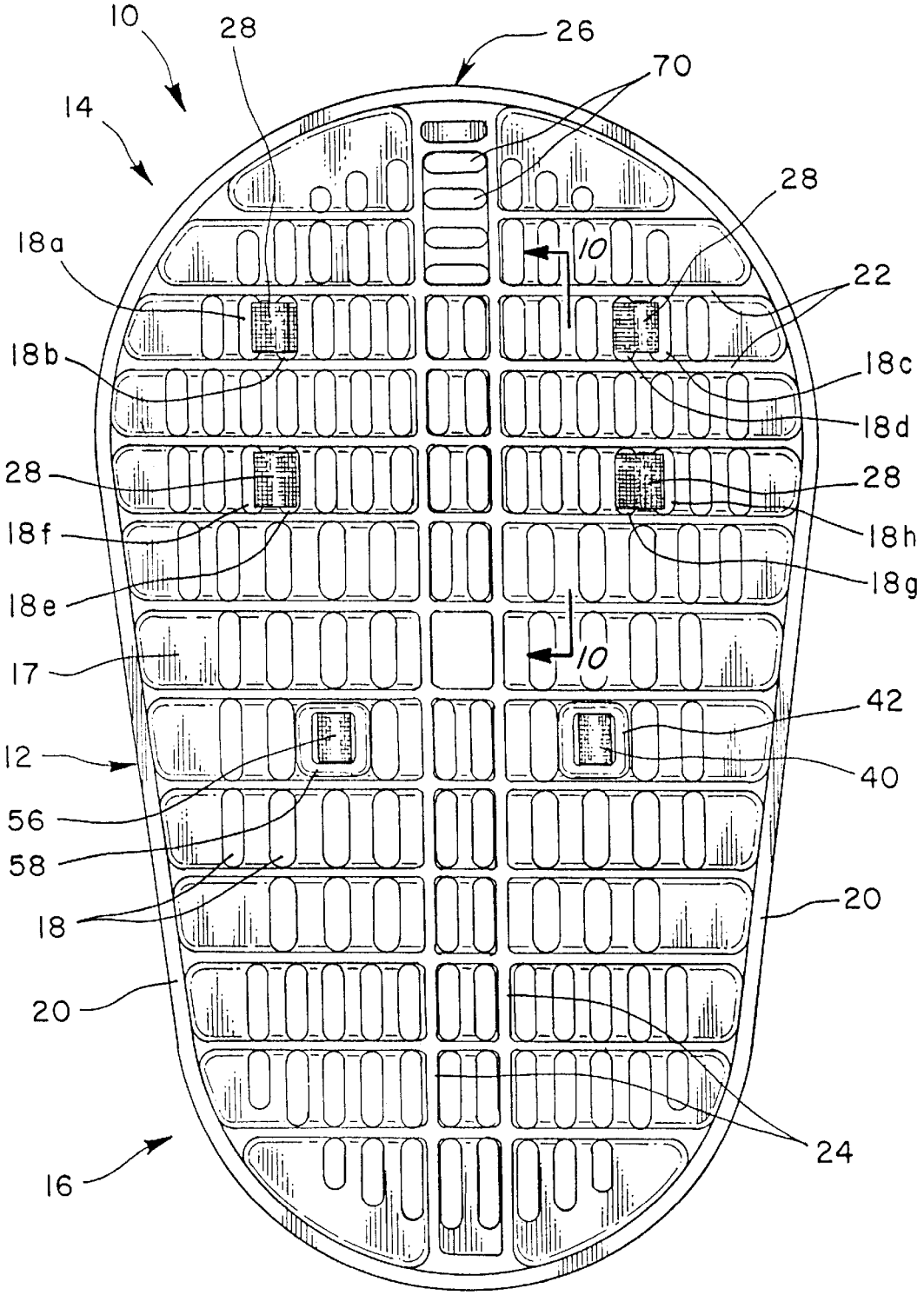
FIG. 3 is bottom view of the first embodiment of this invention.
Figure 4:
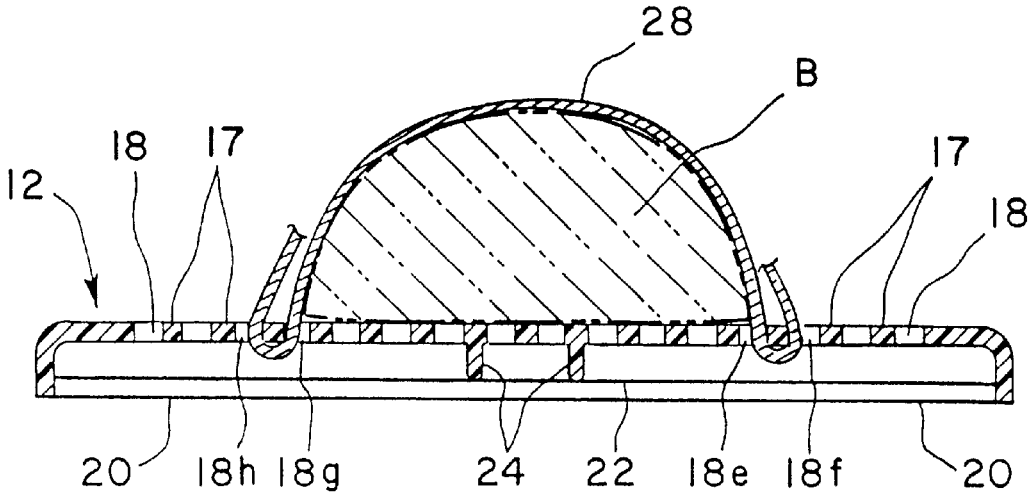
FIG. 4 is lateral vertical sectional view taken along line 4—4 of FIG. 2 illustrating some of the structural detail of the snowshoe platform.

Now moving to FIG. 3, the bottom surface of platform 12 includes a plurality of laterally extending stiffening ribs 22 and a plurality of intersecting longitudinal stiffening ribs 24. As shown, stiffening ribs 22 extend transversely across the entire width of the platform 12. Similarly, longitudinal stiffening ribs 24 extend along the entire length of the platform 12. Although a particular combination of stiffening ribs is illustrated in the preferred embodiment, it will be understood by those skilled in the art that any number of stiffening ribs or geometrical configurations can be used to produce the desired amount of stiffness in the platform. Generally, the use of a greater number of stiffening ribs will result in a more rigid platform. As best seen in FIGS. 4 and 10, stiffening ribs 22 and 24 protrude perpendicularly away from the plane defining platform 12. Also, as shown, curved lip 20 extends slightly beyond ribs 22 and 24 such that curved lip 20 is the first portion of the snowshoe 10 to come in contact with the ground when the snowshoe is in use.

When a wearer of the improved snowshoe engages in a walking action, the platform 12 will flex in response to the amount of pressure placed on the platform and will distribute the applied pressure via the ribs 22 and 24 and the decking 17. Particularly in cold temperatures, it is important that the material used to make the platform be capable of some flexibility without breakage. On the other hand, the platform must be rigid enough to support the weight of the wearer without undue deformation. In practice, it has been found that one material which may be used is a thermoplastic such as polypropylene.

Foot gear such as boot B is placed upon the platform wherein the toe of the boot B is positioned very near the front edge 26 of platform 12. In order to secure the boot B to the platform, a plurality of straps may be used. As shown in the first preferred embodiment, a metatarsal strap 28 may be positioned over the toe and forefoot or metatarsal area. As best seen in FIG. 1, an end retainer 29 may serve as a first point of attachment for securing metatarsal strap 28 to the platform 12. Slots $\mathbf{18}_a$ and $\mathbf{18}_b$ may serve as an anchor point for which to route the strap 28 and attach the end retainer 29. The free end 30 of metatarsal strap 28 may then be strung across the platform 12 along the corresponding row of slots 18 and then secured through opposing longitudinal slots $\mathbf{18}_c$, and $\mathbf{18}_d$ forming a first loop. This first loop provides a means to secure the toe portion of the boot B to the platform 12. If desired, the free end 30 of metatarsal strap 28 may be strung back across the platform 12 and secured through longitudinal slots $\mathbf{18}_e$ and $\mathbf{18}_f$ spaced longitudinally away from the first row of slots to create a second loop and then again strung back across the platform 12 through slots $\mathbf{18}_g$ and $\mathbf{18}_h$ to create yet a third loop, the successive loops providing selective and adjustable securing means for securing the boot B to the platform 12.

Figure 5:
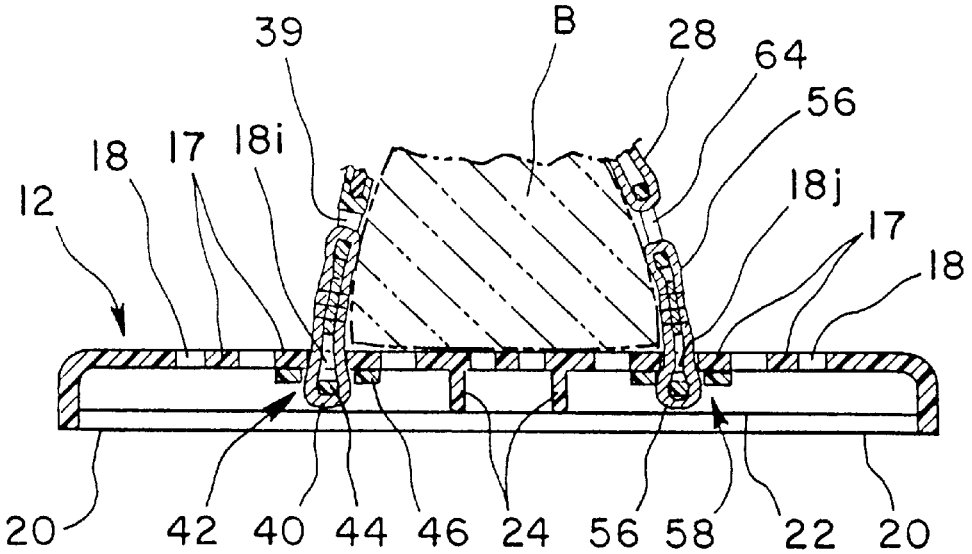
FIG. 5 is another lateral vertical sectional view taken along line 5—5 of FIG. 2.
Figure 6:
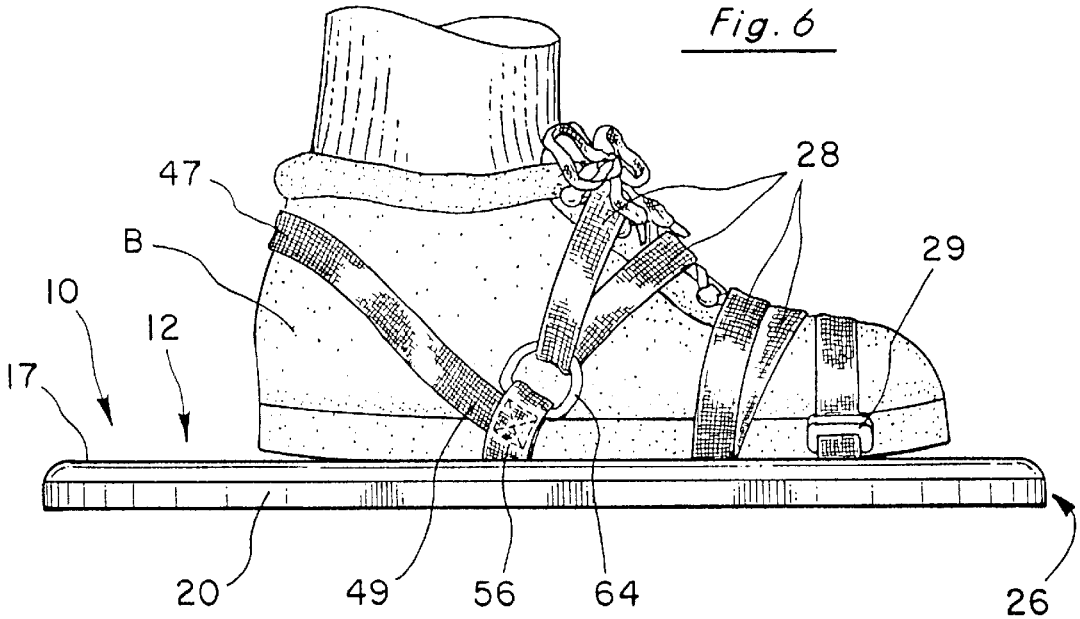
FIG. 6 is a side view of the first embodiment of this invention.

In order to ultimately secure the free end 30 of the metatarsal strap 28 to the platform 12, an adjustable coupler 36 may be used as shown in FIGS. 1 and 10. Adjustable coupler 36 may comprise a male portion 38 which is adjustably secured to free end 30. Female portion 39 of adjustable coupler 36 may be attached to the underside of platform 12 via attaching strap 40 which is secured to the platform through a longitudinal slot $\mathbf{18}_i$. Conveniently, an attaching strap retainer 42, shown in FIG. 3, secures the attaching strap 40 to the platform 12. As seen in FIG. 5, retainer 42 may comprise a central post section 44 surrounded by a buckle-like exterior 46 wherein strap 40 may be looped around the central post section 44 and attached by sewing back upon itself. As shown in FIGS. 2 and 3, strap 28 may have a width which results in a close tolerance fit between the strap and a corresponding slot 18 when the strap 28 is routed therethrough.

In addition to metatarsal strap 28, a heel strap 47 may be used to secure the heel of the boot B to the platform 12. In order to secure the heel strap 47 to the platform 12, one end of adjustor strap 50 may be connected directly to attaching strap 40 as by sewing. The other end of adjustor strap 50 may then be attached to an adjustor retainer 54. As illustrated in FIG. 9, adjustor retainer 54 is similar in construction to attaching strap retainer 42, but simply adds an additional central post 55. Accordingly, adjustor strap 50 may be routed around one central post and attached by sewing upon itself, while heel strap 47 may be routed around the other central post 55. The free end 48 of heel strap 47 may be adjusted to tighten or loosen the heel strap based upon the particular foot gear used with the snowshoe. As with strap 28, strap 47 may have a width resulting in a close tolerance fit between the strap and a corresponding slot 18.

The secured end 49 of heel strap 47 attaches to an intermediate strap 56 as by sewing. Intermediate strap 56 is routed through slot $\mathbf{18}_j$ and is secured to the platform 12 via intermediate retainer 58. Intermediate retainer 58 may be of the same construction as attaching strap retainer 42. In order that the free end 30 of metatarsal strap 28 be secured to the appropriate side of the platform 12, routing ring 64 may be connected to intermediate strap 56 so that the free end 30 is routable therethrough.

Although the first preferred embodiment shows a particular arrangement of straps, it will be understood that a multitude of other strap configurations may be used to secure the desired type of foot gear to the platform 12. Accordingly, the plurality of longitudinal slots 18 provide a nearly limitless number of combinations of possible strap arrangements. For example, the location of end retainer 29 may be positioned more forwardly, rearwardly, or may be moved closer to or farther away from axis A—A to accommodate the first anchor point for which to begin the traversing arrangement of the metatarsal strap 28. Accordingly, the metatarsal strap 28 may then be traversed in the desired manner to provide the required support to secure the boot B to the platform 12. A criss-crossing pattern may be employed or a staggered arrangement of loops may be employed extending transversely across the platform 12, as illustrated in the preferred embodiment, to secure the toe and forefoot or metatarsal area of the boot B to the platform 12. Similarly, attaching strap retainer 42 and intermediate retainer 58 may be positioned along the platform at a desired location to provide the desired position of heel strap 47 and termination of metatarsal strap 28 in order to accommodate the particular foot gear worn.

One advantage of using retainers 42 and 58 is the ease with which they can be located at the desired location on the decking. Each retainer is placed adjacent to the desired slot by rotating and pushing it through the deckplate from the underside to the top side, moving it to the desired slot, and then reinserting it through the top of the deckplate and rotating it so that it is held securely against the underside of the deckplate. The adjustment of retainers 42 and 58 can be achieved without having to reroute any of the straps.

Figure 7:
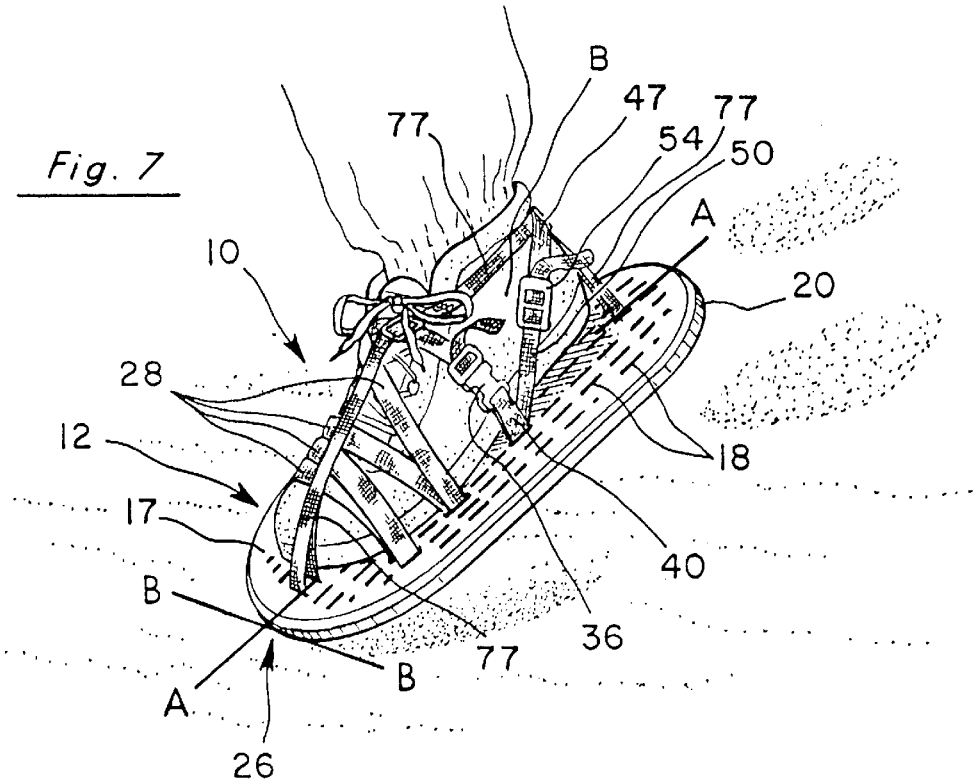
FIG. 7 is another perspective view, on a smaller scale, of the first embodiment of this invention illustrating the axis along which the snowshoe pivots when in use.
Figure 11:
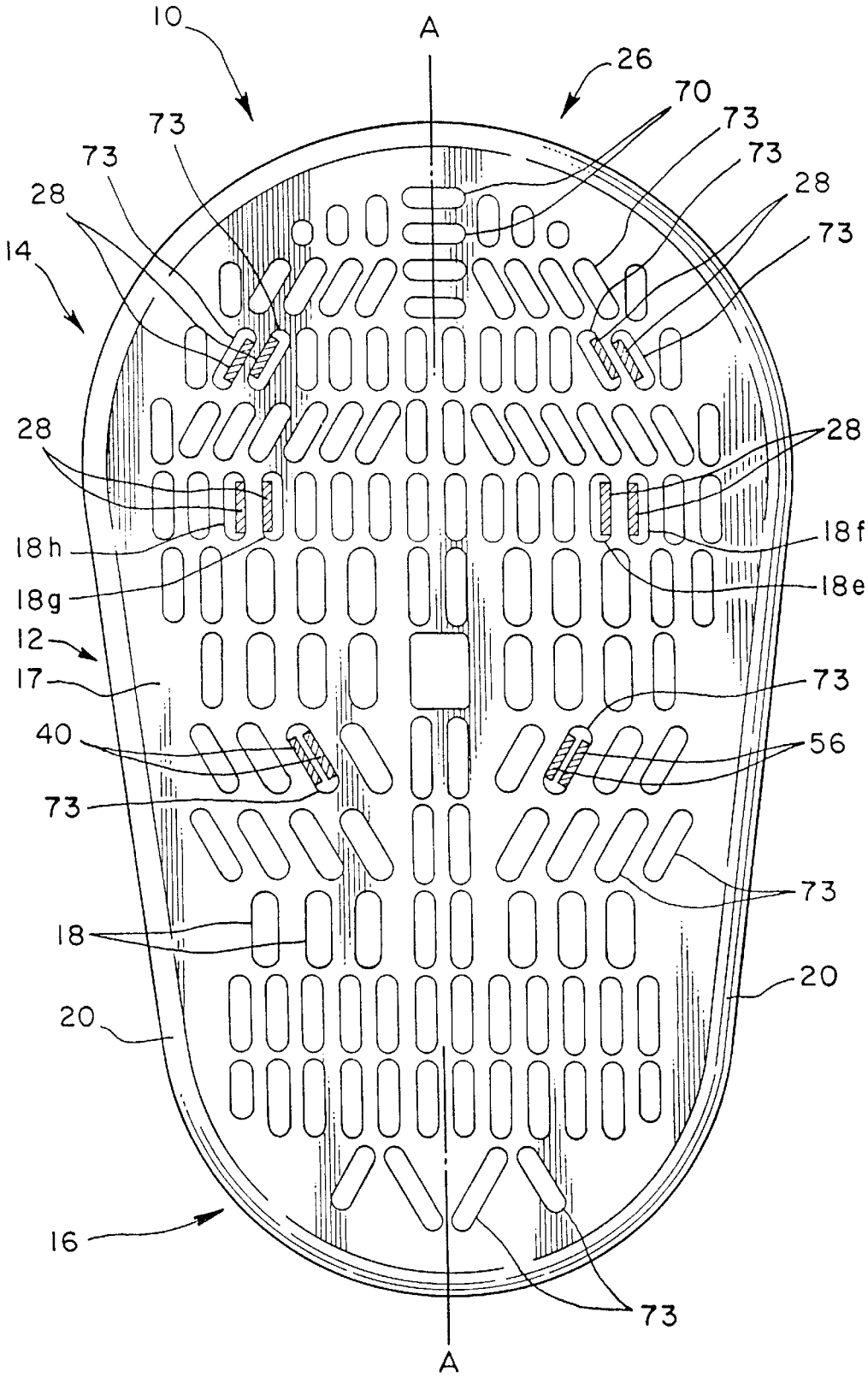
FIG. 11 is a top view of the first embodiment taken along line 2—2 of FIG. 1, further illustrating diagonal slots which may be incorporated on the deckplate.

Conveniently, a short row of transverse slots 70 are provided to accommodate strap support to the toe portion of the boot B in the event that a longitudinally extending strap is directed over the toe portion of boot B. That is, if desired, metatarsal strap 28 may be first anchored through a slot 70 by means of end retainer 29 and then strap 28 may be traversed over the toe of the boot in a longitudinal direction as desired. Strap 28 then may be routed according to the desired strap arrangement so that the boot B is adequately secured to the platform 12. Alternatively, as shown in FIG. 7, an additional longitudinal strap 77 may be used in conjunction with the metatarsal strap 28 and heel strap 47 wherein the additional longitudinal strap 77 is first anchored through a slot 70 and traverses longitudinally over the toe of the boot B and is then secured toward the rear area 16. As with the metatarsal strap 28, the additional longitudinal strap 77 may utilize a structure similar to end retainer 29 in order to anchor the additional longitudinal strap. The additional longitudinal strap 77 may be selectively adjusted to the desired length by utilizing a structure similar to adjustor retainer 54 wherein the free end of the additional longitudinal strap is routed through a slot 18 and then engaged with the retainer 54. Furthermore, as shown in FIG. 11, a plurality of diagonal slots 73 may be provided to accommodate the desired strap support in order to secure the boot B to the platform 12. These diagonal slots may be also used to secure gripping devices such as crampons to the bottom of the snowshoe platform 12. Particularly in conditions where there is frozen snow and ice, a device like a crampon helps in gripping the snow and ice covered terrain. Typically, a crampon may include a plurality of spikes or cleats which protrude into the terrain. As with the longitudinal slots 18 and transverse slots 70, the desired strap may be routed through the diagonal slots 73 for selective attachment of the boot B and crampon to the platform 12.

As shown in FIG. 7, when a wearer begins walking with the first embodiment of this invention, the heel portion of the boot B is allowed to rise but the toe portion of the boot B remains at a substantially fixed location on the platform 12. As the wearer continues walking, the snowshoe pivots about axis B—B which extends perpendicular to axis A—A and which runs adjacently through the front edge 26 of the snowshoe. Because the pivot point is about axis B—B, a wearer of the snowshoe is able to maintain a more natural walking motion. With previous prior art snowshoes, the pivot point is located within the interior of the platform near the ball of the foot which makes walking more difficult because the snowshoe must be lifted after the foot has pivoted.

In the first embodiment, since the foot may be placed nearly flush with the front edge 26 of the platform 12, the wearer is able to "kick" step to provide better edge control for gripping when climbing or traversing sloping surfaces. With traditional snowshoes, a "kick step" is more difficult to achieve because the front portion of the snowshoe extends so far in front of the wearer's foot gear that control of the "kick" is more difficult. Curved lip 20 further enhances edge control enabling a wearer to "kick" step not only in the frontal area of the platform, but also to the sides and rearward area of the platform. Thus, the present snowshoe can be utilized not only on an ordinary snow surface to provide the necessary amount of flotation, but also on sloping terrain because the lip 20 helps to provide the necessary edge control.

Although the foot is illustrated as being placed nearly flush with the front edge 26 of the platform 12, the arrangement of the slots enable a wearer to selectively place the foot at a specific location on the platform. For example, although a more forward positioning of the foot is desirable for providing increased edge control, the wearer may choose to position the foot in a more rearward position on the platform 12, thus shifting the center of gravity in a more rearward direction thereby. Alternatively, it may be desirable to position the foot on the platform either transversely to the left or right so that increased control of the snowshoe is achieved by placing the foot closer to the corresponding edge.

A preferable method of utilizing the first embodiment of this invention is to place the adjustable coupler 36 on the outside portion of the boot B. That is, as illustrated in FIG. 1, the boot B would be a left boot of the wearer. Accordingly, the matching snowshoe for the right foot would have a strap arrangement so that the coupler 36 is positioned to the outside portion of the right foot. However, the wearer may desire to place the adjustable coupler 36 on the inside of the foot. Therefore, the snowshoe of this invention could be used with the right boot of a wearer. Because the platform 12 is symmetrical about axis A—A, a wearer would experience the same amount of flotation support regardless of whether a left or right foot gear is chosen with a particular snowshoe.

Figure 13:
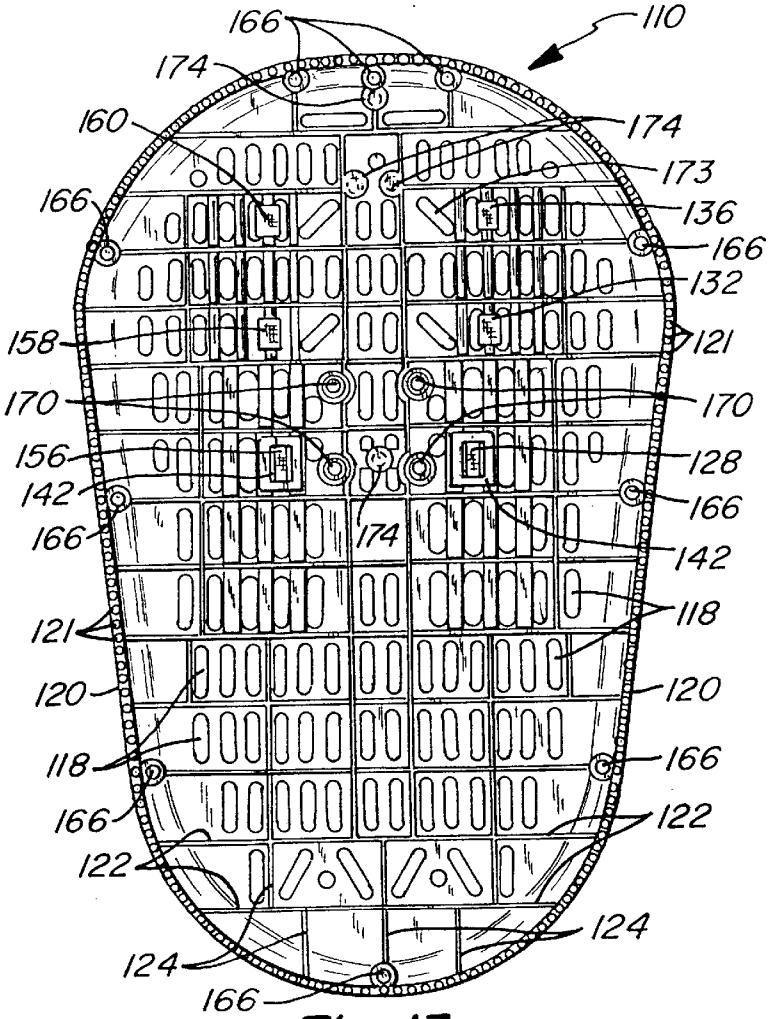
FIG. 13 is bottom view of the second embodiment of this invention.
Figure 14:
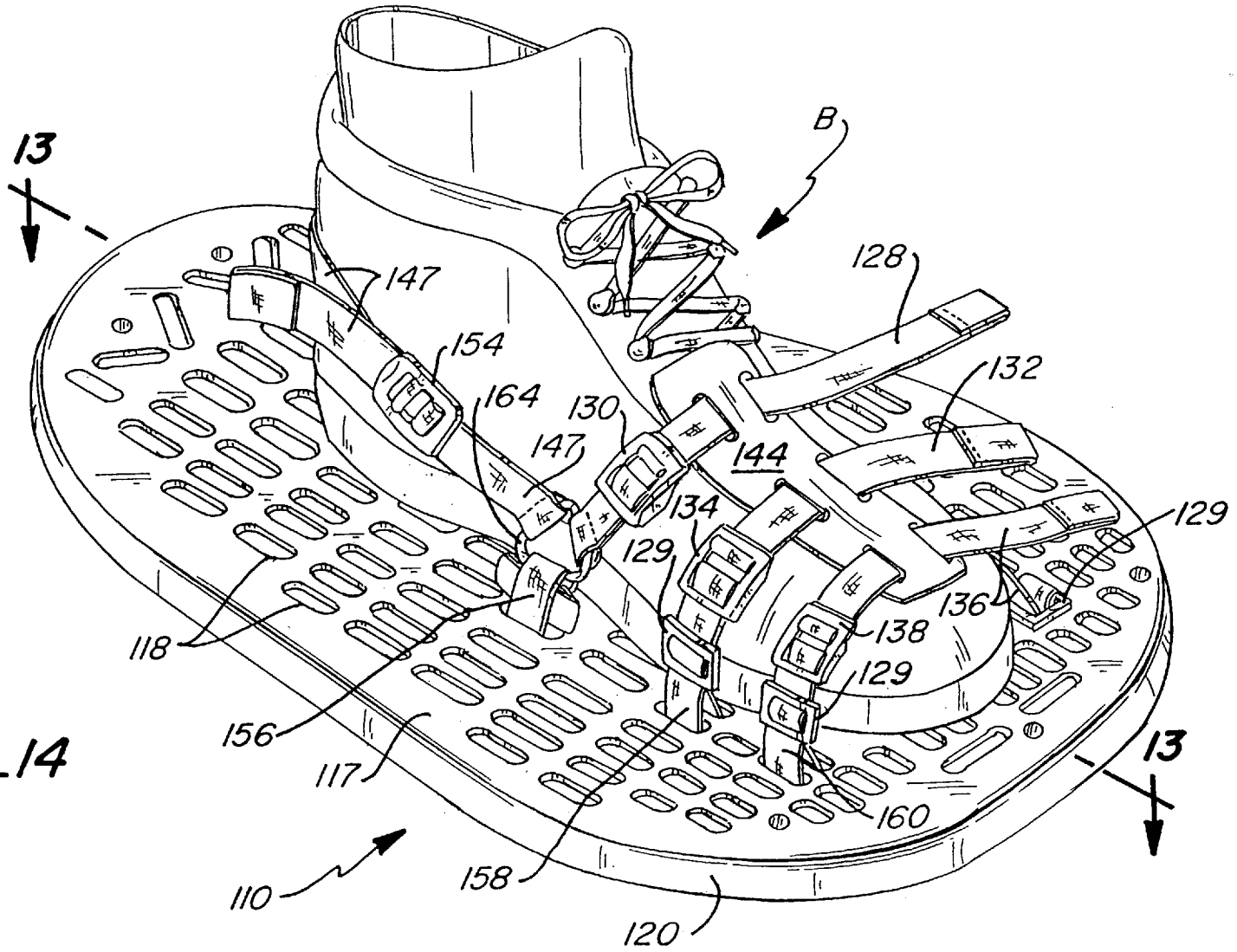
FIG. 14 is a perspective view of the first or second embodiment of this invention which incorporates an alternate strap arrangement.

A second preferred embodiment of the improved snowshoe of this invention is disclosed in FIGS. 12–18. The second embodiment includes a deckplate structure which is very similar to the first embodiment, with the exception of some additional openings which enable the second embodiment to receive a number of differing types of bindings. Additionally, the second embodiment is still compatible for use with any number of differing types of straps arrangements, FIG. 14 illustrating one alternative strap arrangement.

Figure 12:
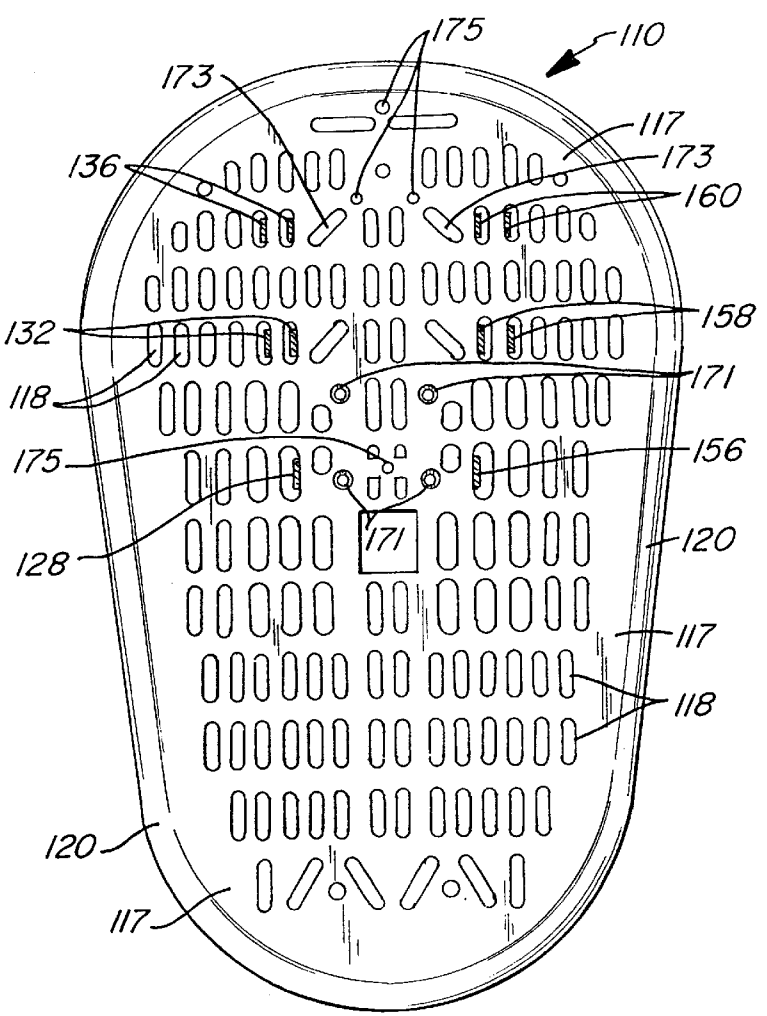
FIG. 12 is a top view of a second embodiment taken along line 12—12 of FIG. 14.

As best seen in FIGS. 12–14, the second embodiment illustrates a snowshoe 110 including a platform structure 112 having a decking 117 which is surrounded by a peripheral curved lip 120. A plurality of slots 118 are formed through the deckplate and are positioned between a plurality of lateral ribs 122 and longitudinal ribs 124. The functioning and arrangement of each of the foregoing elements of the second embodiment are the same as that of the corresponding structural elements in the first embodiment.

As illustrated in FIG. 14, the second embodiment may include an alternate strap arrangement. As shown, the metatarsal region of the boot B may be secured by an upper metatarsal strap 128. The toe portion of the boot B may be secured by a toe strap 136. A lower metatarsal strap 132 may be placed between the upper metatarsal strap 128 and the toe strap 136. Each of the foregoing straps may include a corresponding adjustable retainer member in order that the strap be fitted to the particular sized boot. Accordingly, adjustable retainers 130, 134 and 138 are provided as illustrated. Straps 128, 132 and 136 are each anchored to one side of the decking 117. Short attaching straps 158 and 160 are routed through slots in the decking 117 and attach to retainers 134 and 138, respectively, for anchoring straps 132 and 136 to the opposite side of the decking. As with the first embodiment, the second embodiment may include a heel strap 147 which has a corresponding adjuster retainer 154. The heel strap 147 is secured to the deckplate 117 via the routing ring 164 and intermediate strap 156 which is routed through the decking 117. The ends of straps 128, 132, 136, 158 and 160 may each include end retainers 129 which stabilize the straps over their corresponding slots in the decking. Conveniently, a tongue 144 may be secured by straps 128, 132 and 136. The tongue 144 serves to properly fix the strap arrangement over the boot B.

As illustrated in FIG. 14, straps 128 and 156 may be located at desired positions along the decking 1 17 by strap retainers 142. Although not illustrated in FIG. 14, the remaining straps of the second embodiment may also incorporate strap retainers 142 as shown in FIG. 13.

As further illustrated in FIG. 13, the bottom surface or underside of the snowshoe 110 may include a plurality of gripping nubs 121 which are formed along the lower surface of the peripheral curved lip 120. These gripping nubs assist a wearer to traverse ice covered terrain. Additionally, a plurality of ice cleat bases 166 are provided along the periphery of the decking 117. The ice cleat bases each include an opening for which to receive an ice cleat 168. Typically, the ice cleat is a short cylindrical member which further assists the snowshoe wearer in traversing ice covered terrain.

As illustrated in FIGS. 12 and 13, the second embodiment of this invention includes a plurality of additional openings for which to receive differing types of bindings. A first set of additional openings are defined by a grouping of four base sleeves 170 which protrude from the bottom of the decking. A threaded insert 171 is inserted into each one of the base sleeves 170. This first set of additional openings are configured to receive a standard snowboard binding, as further discussed below. A second set of additional openings 175 are provided through deckplate 117. Openings 175 are defined by corresponding base sleeves 174 which protrude from the bottom side of the decking 117. This second set of additional openings are adapted to receive standard cross-country-type ski bindings, as further discussed below.

Figure 15:
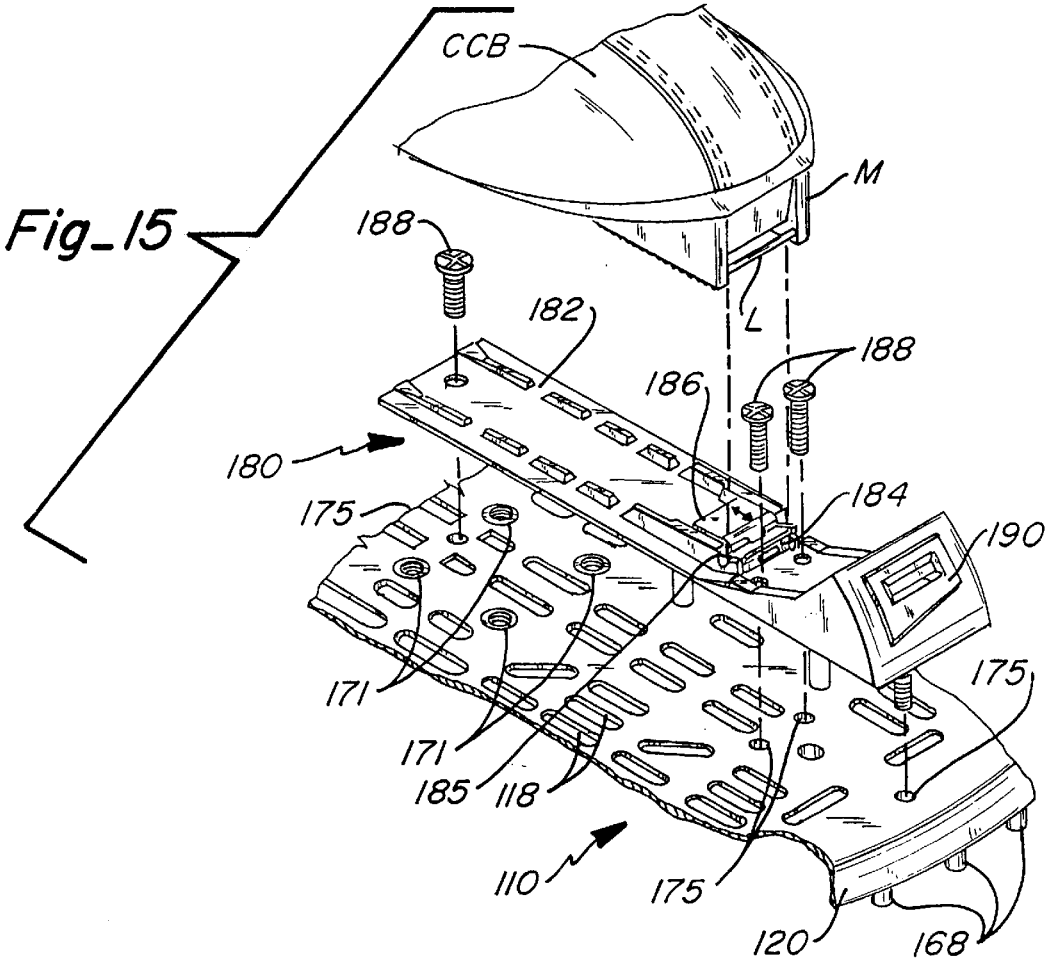
FIG. 15 is a fragmentary exploded perspective view of the second embodiment of this invention illustrating a step-in type cross-country ski binding attached to the decking.
Figure 16:
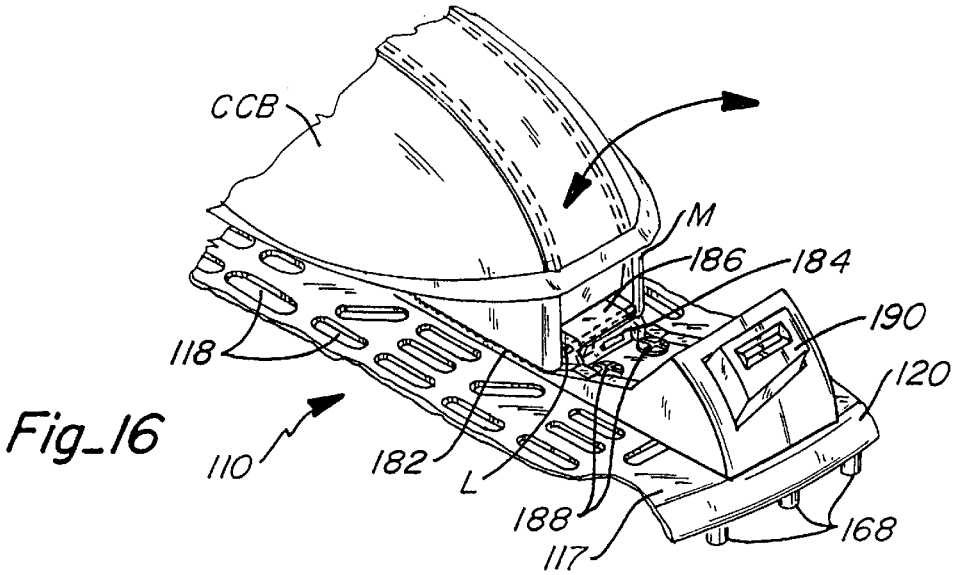
FIG. 16 is a fragmentary perspective view of the step-in type cross-country ski minding attached to the decking along with a cross-country boot ski engaged with the cross-country ski binding.

FIG. 15 illustrates a step-in type cross-country binding 180 attached to the decking 117. As well understood by those skilled in the art, the standard step-in type cross-country ski binding 180 includes a baseplate 182 located at one end of the binding 180, and a push release mechanism 190 located at the opposite end thereof. A standard cross-country ski boot CCB is illustrated as including a locking bar L mounted to the mount portion M located at the toe portion of the boot. In operation, the locking bar L is placed in the gap 185 between rigid locking tab 184 and slide portion 186. The cross-country ski boot is secured in place by engagement of the locking tab 184 against the slide portion 186 when it slides to the locked position. As shown in FIG. 16, when the cross-country ski boot is attached to the decking 117 in the manner described above, the boot may pivot about locking bar L.

Figure 17:
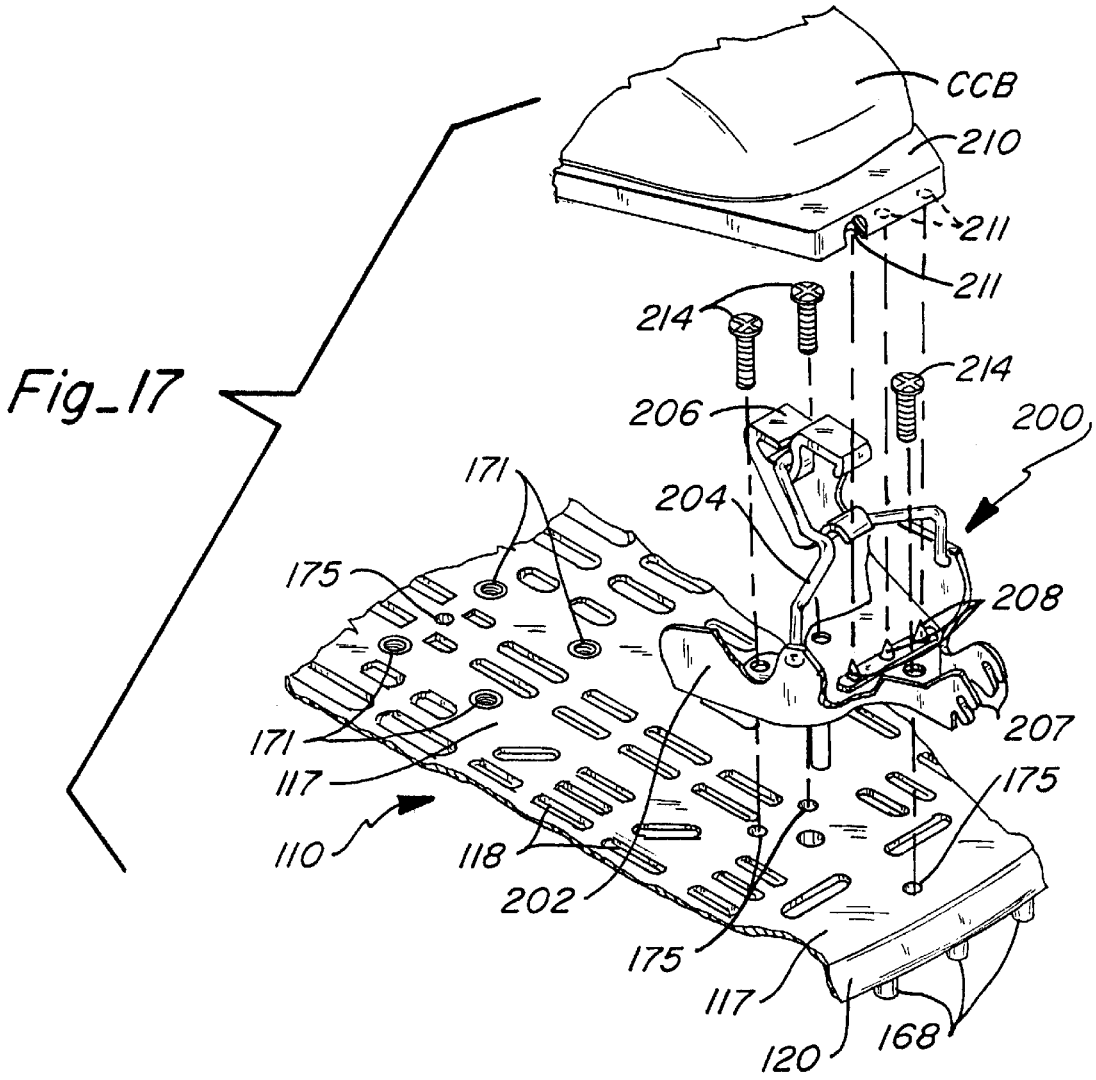
FIG. 17 is a fragmentary exploded perspective view of the second embodiment showing a latching lever type cross-country ski binding secured to the decking of the improved snowshoe.

As illustrated in FIG. 17, the second set of openings 175 in the deckplate 117 are also adapted to receive a latching lever-type cross-country ski binding 200. As also understood by those skilled in the art, the standard latching-lever type cross-country ski binding includes a base section 202 and an adjustable locking member 206 which engages which grooves 270 when the cross-country ski boot CCB is placed within the binding. In operation, the toe portion 210 of the boot is placed within the binding 200 by aligning boot recesses 211 with protrusions 208 located on the base 202. The adjustable locking member 206 is then engaged with the desired groove 207 by rotating latching lever 204 in a clockwise direction. A plurality of screws 214 may be used to attach the binding 200 to the decking 117.

Figure 18:
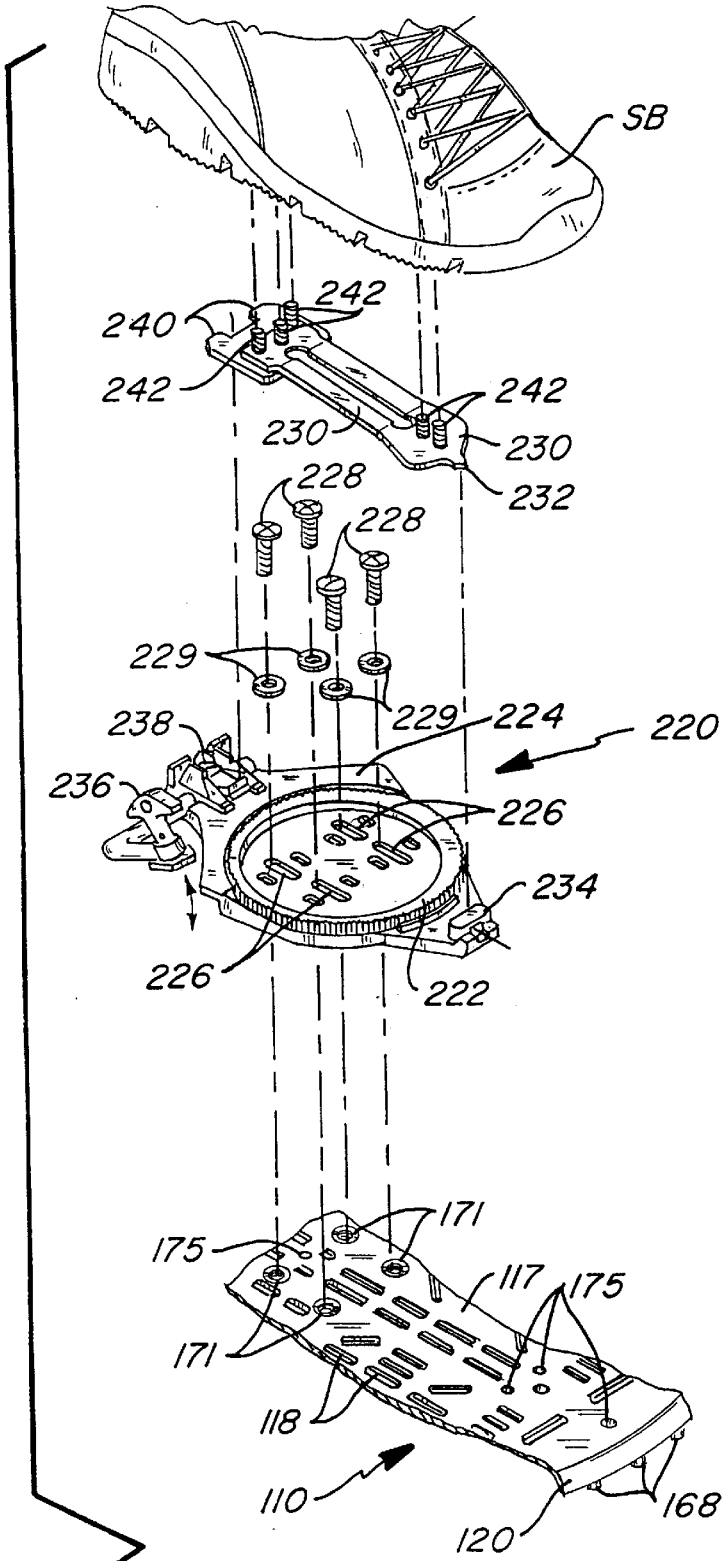
FIG. 18 is a fragmentary exploded perspective view of the second embodiment illustrating a snowboard binding secured to the decking of the improved snowshoe of this invention.

As illustrated in FIG. 18, the second embodiment of this invention is also adapted to receive a snowboard-type binding assembly 220. As also well understood by those skilled in the art, a common snowboard binding assembly 220 includes a baseplate 224 and a rotatable dial member 222 mounted thereover which may be rotated to the desired position for aligning the foot with respect to a desired orientation on a snowboard. When mounted to the snowshoe of this invention, the dial member 222 is rotated to align the foot in parallel with the longitudinal axis of the snowshoe. A plurality of slots 226 are formed in the baseplate to enable screws 228 to engage the decking 117 at a desired location thereon. Boot plate 230 is attached directly to the tread of the snowboard boot SB as by screws 242. Screws 228 are insertable through the washers 229 and the corresponding threaded inserts 171. In operation, the tip portion 232 of boot plate 230 is inserted within tip retainer 234 located at the forward end of the binding 220. The heel of the boot SB is then rotated downwardly so that heel lock member 238 of the binding assembly 200 is inserted between forked member 240 of the boot plate 230. In order to remove the snowboard boot from the binding assembly, biased engaging handle 236 may be rotated counter clockwise to release protruding portion 238 from the forked member 240.

Figure 19:
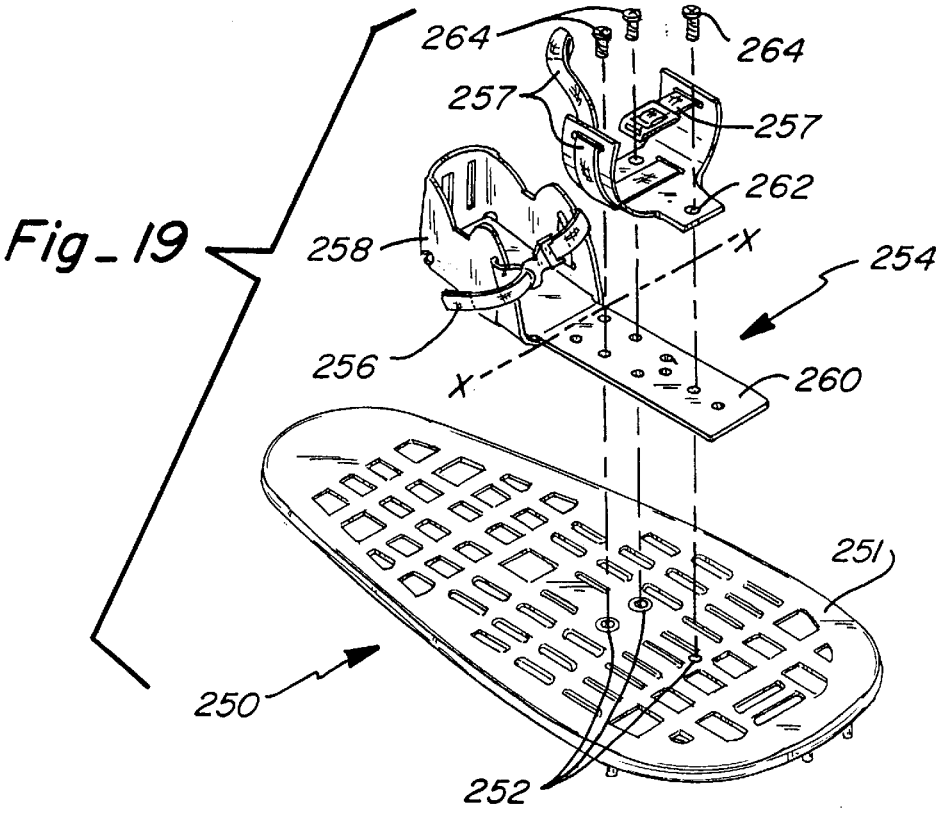
FIG. 19 is an exploded perspective view of a third embodiment of this invention which may include yet another type of binding attached to the decking, and which is especially adapted for use by children.

As illustrated in FIG. 19, a third embodiment of the invention is provided in the form of a child's snowshoe. The decking 251 of the snowshoe 250 is substantially similar to that of the deckings in the first and second embodiments. That is, there are a plurality of slots formed through the deckplate and the bottom side of the deckplate has a plurality of longitudinally and laterally extending ribs. This particular embodiment includes a three-hole pattern defined by threaded inserts 252. This three-hole pattern is similar in spacing and arrangement to openings 175 of the second embodiment. In this third embodiment, the snowshoe is shown as receiving another type of cross-country binding as manufactured by Alternative Binding Resources, Inc. As shown, binding 254 includes a heel cup 258 attached to a base member 260. A metatarsal strap 256 and toe strap 257 are provided to secure the foot gear engaged with the binding 254. The toe strap 257 may be mounted to the removable metatarsal portion 262 which itself is separately attached to base 260. This particular type of binding has a laterally extending pivot point about axis X—X. The pivot or hinge action around axis X—X enables the wearer to achieve the characteristic cross-country ski motion wherein the ski is allowed to rotate about some point along the length of the foot.

Figure 20:
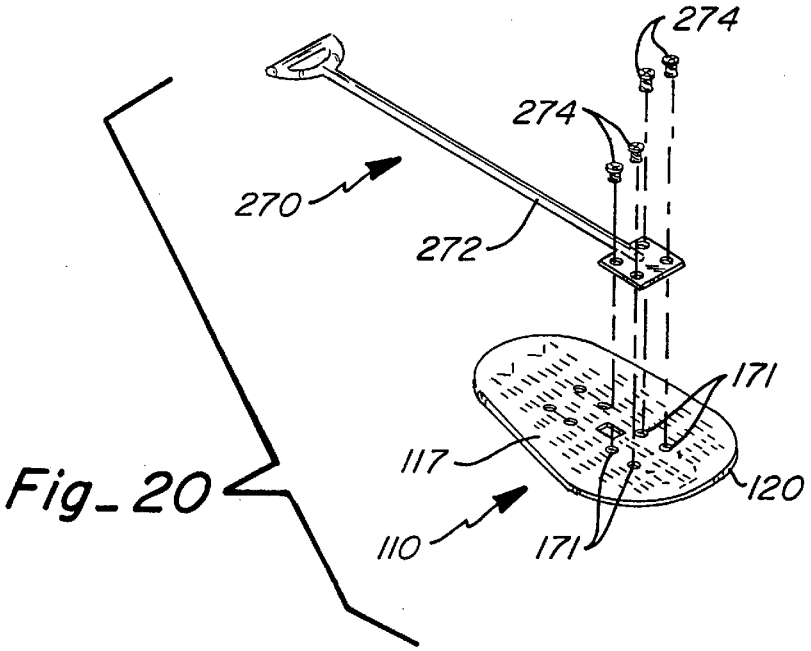
FIG. 20 is an exploded perspective view of a fourth embodiment of this invention illustrating the capability of the deck structure of the improved snowshoe to be used as an implement, such as a shovel, by attaching a separable handle member to the decking.

In a fourth embodiment of this invention, as illustrated in FIG. 20, the improved snowshoe of this invention may be converted for use as an implement such as a shovel or the like. In situations where deep snow conditions exist, a skier, snowboarder or snowshoer may have a need to dig into the snow. For example, a cross-country skier may wish to uncover a trail sign which has been covered with snow. Accordingly, the deck structure of this invention may receive a handle member 270 which attaches to the decking 117 by a plurality of screws 272. The screws can be alignable with either the first or second set of openings formed in the decking 117. As illustrated in FIG. 20, the screws 272 align with the four-hole pattern defined by threaded inserts 171. Although the handle number 270 is shown attaching to the decking 117 in one direction, it may be reversed so that the free end of the handle member 270 is at the opposite end of the decking. In operation, the snowshoe 110 is an effective digging tool because the snowshoe is substantially rigid. Furthermore, the peripheral curved lip 120 provides a rigid edge with which digging even in frozen snow is possible. The handle 270 can be modified to attach to the decking 117 by openings other than those defined by threading inserts 171. For example, the handle can be attached to the decking 117 through any one of the longitudinal slots, or through openings 175.

A fifth embodiment of the invention is provided in the form of a child's snowshoe which is similar to the third embodiment of FIG. 19. As shown in FIGS. 21 and 22, the snowshoe 300 of this embodiment also includes a snowshoe decking 301 which is substantially similar to the deckings illustrated in the first, second and third embodiments. That is, there is a plurality of slots formed through the deck plate, and the bottom side of the deck has a plurality of longitudinally and laterally extending ribs. As with the third embodiment, this particular embodiment also includes a three-hole pattern for securing the binding 304 as by threaded inserts 302. The binding 304 of this embodiment also includes a metatarsal strap 306 which traverses across the metatarsal portion of the wearer's foot. As shown, this strap 306 may be separated by a coupler including a male portion 308 and a female portion 309. The male portion 308 has an adjustment feature which enables that end of the strap 306 to be adjusted to a desired length. A rear binding portion or heel cup 312 is provided to support the heel portion of the wearer's foot. A base portion 314 attaches to the heel cup 312 and serves as the structure by which the binding may be attached to the decking 301. A forward binding portion 316 is separately attached to the base 314. Forward binding portion 316 serves to secure the forward portion of the wearer's foot, and also serves to mount the toe strap 310. A toe strap adjuster retainer 311 is used to secure the ends of the toe strap 310 and also to allow the length of the toe strap to be adjusted as desired. A plurality of screws 318 are used to secure the forward binding portion 316 through openings formed in 316 which align with inserts 302. Base 314 includes a plurality of openings 315 which align with inserts 302 and which can be used to selectively position the binding 304 in either a more forward or more rearward location on the decking 301. As with the embodiment of FIG. 19, this particular type of binding has a laterally extending pivot point about axis Y—Y. This pivot point or hinge action about axis Y—Y enables the wearer to achieve the characteristic cross country ski motion wherein the ski is allowed to rotate about some point along the length of the foot.

Because the binding 304 is able to be used with many types of foot gear, it is also important that metatarsal strap 306 be able to rotate so as to secure either a higher or lower portion along the metatarsal portion of the foot. For example, with snowboots or more bulky foot gear, it may be advantageous to have the metatarsal strap secured about the wearer's foot in a higher metatarsal area. This rotational capability is achieved by connecting the metatarsal strap 306 to the heel cup 312 by a pair of protruding buttons 320 located on opposite exterior sides of heel cup 312. As best seen in FIG. 22, the button 320 extends away from the heel cup 312 the length of neck 321. A metatarsal strap retainer 322 is used to terminate and secure both end sections of the metatarsal strap 306. This strap retainer 322 includes a larger opening 324, and a smaller opening 326 which slightly overlaps or intersects with the larger opening 324 at the opposed ridge sides 328. The strap retainers 322 are attached by aligning openings 324 with the buttons 320 and applying pressure such that the buttons 320 are secured in openings 324. The buttons 320 are sized to have a close friction fit with the interior edges of the strap retainers 322 defined by larger openings 324. If it is desired to secure metatarsal strap 306 for use, the strap is pulled upwardly in the direction of arrow B to cause neck 321 to reside in small opening 326. Once in place, metatarsal strap 306 may be rotated as indicated by arrows A. If a wearer wishes to completely remove the metatarsal strap, or wishes to remove one end of the metatarsal strap without disconnecting the male and female portions 308 and 309 of the coupler, force is applied to the strap retainer 322 in a downward direction opposite arrow B which allows neck 321 to be removed from the smaller opening 326 and to reside in the larger opening 324. The strap retainer 322 is then pulled away from the protruding button 320.

This invention has been described in detail with reference to particular embodiments hereof, but it will be understood that various other modifications can be effected within the spirit and scope of this invention.

I claim:

1. A snowshoe for securing a desired foot gear thereto, said snowshoe comprising:

a platform including a plurality of spaced slots formed through said platform, said slots arranged in a plurality of rows extending laterally across said platform and spaced longitudinally along said platform;

a binding attached to said platform for securing the foot gear thereto, said binding including:

means for securing a rear portion of the foot gear to the platform, said means for securing being hinged about an axis extending laterally across the platform, said means for securing including a pair of protrusions located on opposite sides of said means for securing;

a metatarsal strap having first and second ends, said first and second ends of said metatarsal strap each including a strap retainer, each said strap retainer having a larger opening and a smaller opening partially intersecting said larger opening, wherein said metatarsal strap may be removably attached to said protrusions at said first and second ends by said strap retainers by inserting said protrusions through said larger openings and displacing said strap retainers to cause said protrusions to overlie said smaller openings, such that said ends of said metatarsal strap are rotatable about said protrusions enabling said metatarsal strap to accommodate different-sized foot gear; and a toe strap attached to said binding for securing a forward portion of the foot gear to said platform.

2. A snowshoe for securing a desired foot gear thereto, said snowshoe comprising:

a platform including a plurality of spaced slots formed therethrough;

a binding attached to said platform for securing the foot gear thereto, said binding including:

a rear binding portion;

a protruding button spaced from said rear binding portion;

a neck interconnecting said protruding button and said rear binding portion;

a metatarsal strap secured to said rear binding portion at first and second ends thereof, said first end having a strap retainer for releasable engagement with said protruding button, said strap retainer having a larger opening and a smaller opening partially intersecting said larger opening, wherein said strap retainer is engaged with said protruding button by aligning said protruding button with said larger opening, and forcing said protruding button through said larger opening, said first end of said metatarsal strap being rotatable with respect to said protruding button by then displacing said strap retainer to cause said neck to reside in said smaller opening; and a forward binding portion spaced from said rear binding portion on said platform, said forward binding portion including a toe strap.

3. A snowshoe adapted for use with a desired foot gear, the foot gear including a boot plate attached to the sole of the foot gear, the boot plate including a protruding tip located at a first end of the boot plate, and a forked member located at an opposite end of the boot plate, said snowshoe comprising:

a platform including a plurality of spaced slots formed through said platform, said slots being arranged in a plurality of rows extending laterally across said platform and spaced longitudinally along said platform;

a binding attached to said platform for releasably securing the foot gear thereto, said binding including;

a base member secured to said platform, said base member including a rotatable dial member mounted thereover, said rotatable dial member enabling the foot gear to be placed at a desired angle with respect to a longitudinal axis of said platform;

a tip retainer mounted to a first end of said base member;

an engaging handle including a protruding portion, said engaging handle mounted to a second end of said base member; and wherein said foot gear is secured to said binding by inserting the protruding tip of the boot plate in said tip retainer, and rotating the foot gear downwardly so that said protruding portion of said engaging handle is inserted between the forked member on the boot plate.

* * * * *

UNITED STATES PATENT AND TRADEMARK OFFICE

CERTIFICATE OF CORRECTION

PATENT NO. : 5,970,632

DATED : October 26, 1999

INVENTOR(S) : Jim Watson

It is certified that error appears in the above-indentified patent and that said Letters Patent is hereby corrected as shown below:

Column 5, line 21, delete "Rotational" and insert --flotational--.

Signed and Sealed this

Twenty-fifth Day of July, 2000

*Attest:*

*Attesting Officer*

Q. TODD DICKINSON

*Director of Patents and Trademarks*